US006675721B2

(12) United States Patent
Zeiders

(10) Patent No.: US 6,675,721 B2
(45) Date of Patent: Jan. 13, 2004

(54) ADJUSTABLE SPORTING EVENT TABLE

(76) Inventor: Cynthia J. Zeiders, 102 W. George Huff Dr., Urbana, IL (US) 61801

( * ) Notice: Subject to any disclaimer, the term of this patent is extended or adjusted under 35 U.S.C. 154(b) by 0 days.

(21) Appl. No.: 09/784,711

(22) Filed: Feb. 15, 2001

(65) Prior Publication Data

US 2002/0117092 A1 Aug. 29, 2002

(51) Int. Cl.[7] ..... A47B 23/00
(52) U.S. Cl. ..... 108/43; 108/25
(58) Field of Search ..... 108/25, 26, 43, 108/44, 115; 297/4

(56) References Cited

U.S. PATENT DOCUMENTS

| | | | | | |
|---|---|---|---|---|---|
| 1,895,338 | A | | 1/1933 | Neumann | |
| 2,189,247 | A | | 2/1940 | Johnson | |
| 2,692,175 | A | | 10/1954 | Jacques | |
| 2,787,507 | A | | 4/1957 | Powers | |
| 3,123,935 | A | | 3/1964 | Williams | |
| 3,414,323 | A | | 12/1968 | Mitchum | |
| 3,693,555 | A | * | 9/1972 | Holtzmann | 108/25 |
| 3,709,158 | A | * | 1/1973 | Kidd | |
| 4,144,822 | A | | 3/1979 | Roberts et al. | |
| 4,177,737 | A | | 12/1979 | Brickman | |
| 4,404,915 | A | | 9/1983 | Simpson | |
| 4,466,659 | A | | 8/1984 | Carpentier et al. | |
| 4,715,652 | A | | 12/1987 | Ward | |
| 4,940,003 | A | * | 7/1990 | Mayhew et al. | 108/25 X |
| 4,972,781 | A | | 11/1990 | Montgomery et al. | |
| 5,417,168 | A | | 5/1995 | Soper | |
| 5,427,292 | A | | 6/1995 | Rousch | |
| 5,460,102 | A | * | 10/1995 | Pasmanick | 108/43 |
| 5,479,866 | A | * | 1/1996 | Rae | 108/44 |
| 5,520,119 | A | | 5/1996 | Eisenberg | |
| 5,535,682 | A | | 7/1996 | Aigeldinger | |
| 5,642,674 | A | | 7/1997 | Joye, Sr. et al. | |
| 5,878,672 | A | * | 3/1999 | Ostermann et al. | 108/25 X |
| 6,044,758 | A | | 4/2000 | Drake | |

* cited by examiner

*Primary Examiner*—Jose V. Chen
(74) *Attorney, Agent, or Firm*—Trexler, Bushnell, Giangiorgi, Blackstone & Marr, Ltd.

(57) ABSTRACT

A portable table which can be used in relatively confined settings. The table includes two vertical supports which are placed on either side of the user's legs and rest on the floor when the table is in use. The supports are hingedly attached and fold underneath the table to allow for the table to be transported easily.

14 Claims, 2 Drawing Sheets

ADJUSTABLE SPORTING EVENT TABLE

BACKGROUND OF THE INVENTION

The present invention is generally directed to an adjustable table. More particularly, the present invention contemplates a portable, adjustable table for use in an arena or stadium.

People gather in stadiums and arenas to be entertained for a multitude of events, including baseball games, football games, and car races. Some stadiums or arenas provide benches and others provide individual seats which are positioned close to each other in which viewers sit. In either case, the stadium seating is generally not designed for comfort, but to maximize the capacity of the stadium. Therefore, the amount of space provided for each viewer to watch the event is generally small.

Most stadiums and arenas do not provide a table or surface on which items can be rested while the viewer is seated. Although viewers will often consume food and beverages while watching the events, because seating is tightly spaced it is often difficult and/or uncomfortable to balance or manage food and beverages in the confined allotment of space. Additionally, it is difficult to browse through an event program when grasping a drink or sandwich.

When viewing events on television, viewers often use "TV trays" to support their food and beverages. TV trays are generally light weight so that they can be easily moved short distances to a desired location within the home. TV trays however are not designed to be transported in a vehicle or carried by an individual for longer distances, for example, from a parking lot to a seat within a stadium. Generally, events at a stadium draw many people, therefore, visitors must be able to manage the items they bring into the stadium amongst the large crowds of people. Items which are compact and light weight are preferable so that an individual can move more easily through the crowded areas.

It is also important that items used within a stadium are not too large. Not only are the seats placed closely together from side to side, but the rows of seating are also place closely together. A narrow passageway in front of each row of seats is available for leg room and for other viewers to pass through to reach or leave their seat. Because the space in front of each viewer is limited, the typical "TV tray" will not fit in the passageway. It is therefore desirable to provide a table which can be supported with relatively narrow supports which do not occupy a large amount of floor space.

The present invention provides an adjustable table which overcomes the problems presented in the prior art and which provides additional advantages over the prior art, such advantages will become clear upon a reading of the attached specification in combination with a study of the drawings.

OBJECTS AND SUMMARY OF THE INVENTION

A general object of the present invention is to provide a table which can be used in a small amount of space.

Another object of the present invention is to provide a table which can be transported easily.

Another object of the present invention is to provide a surface upon which spectator can rest items.

A further object of the present invention to provide a table with adjustable height.

Briefly, and in accordance with the foregoing, the present invention discloses a table which can be easily transported.

The dimensions of the table are such that the table can be used in confined spaces such as a sporting event.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
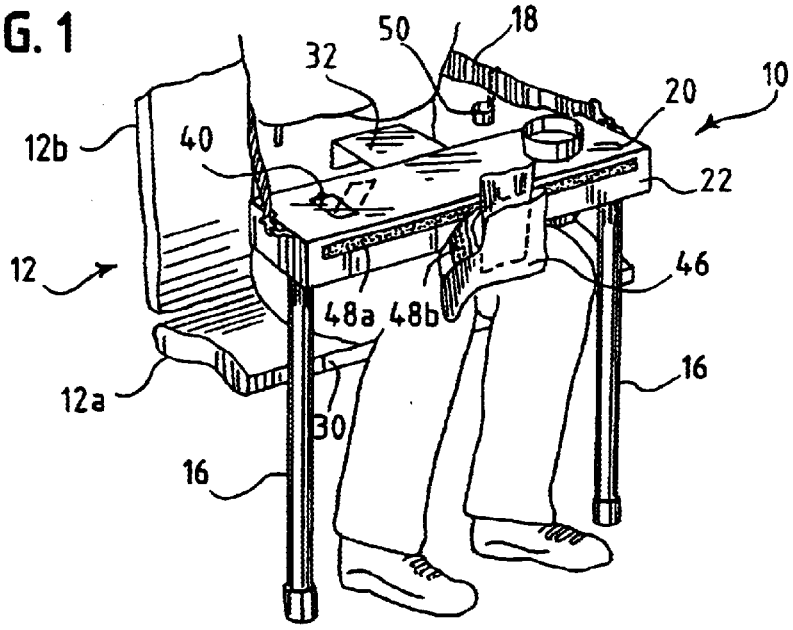
FIG. 1 is a perspective view of an embodiment of the table of the present invention in its upright form along with a user seated by the table in a typical stadium seating arrangement.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

FIG. 1 shows the table 10 of the present invention. The user of the table 10 is seated in a bench 12 similar to those commonly used at stadiums and arenas. As shown, the bench 12 is comprised of a generally horizontal seat portion 12*a* and a vertical back support portion 12*b*. The back support portion 12*b* is not necessary for use of the present invention. Although FIG. 1 shows the user seated at a bench 12, it is to be understood that the table of the present invention could also be used by a user seated in a chair.

The table 10 includes a horizontal member 14, two supports 16, and a supportive strap 18.

The horizontal member 14 of the table 10 has a top surface 20 which is generally rectangular in shape. An edge 22 depends from the perimeter of the top surface 20.

The upper end 24 of each support 16 is preferably hingedly attached to the bottom surface of the horizontal member 14 by hinges 26. Each hinge 26 is centered and attached near the end of the horizontal member 14. The hinges 26 allow the supports 16 to be moved from a position perpendicular to the horizontal member 14 to a position parallel to the horizontal member 14. The hinges 26 are suitably constructed so as to prevent the supports 16 from pivoting more than ninety degrees. Thus, the support 16 can move from a position parallel to the horizontal member 14 ninety degrees to a position perpendicular to the horizontal member 14. However, the support 16 can not move beyond the position perpendicular to the horizontal member 14.

Figure 5:
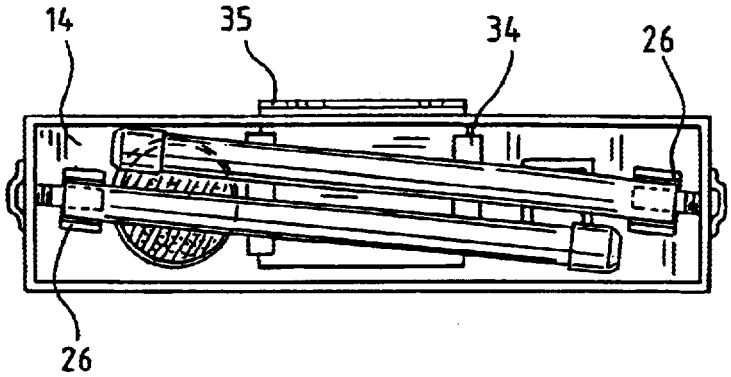
FIG. 5 is a bottom plan view of the table shown in FIGS. 1–4 in the configuration used to transport the table.

As shown in FIG. 5, the hinges 26 are mounted at an angle relative to the horizontal member 14. Mounting the hinges in this manner allows from the supports 16 to fold under the horizontal member 14 as will be described herein. In the preferred embodiment, the supports 16 are made from hollow, telescoping poles 27*a*, 27*b*. The telescoping poles 27*a*, 27*b* allow the height of the table 10 to be adjusted as desired by the user. In the preferred embodiment, the end of each vertical support 16 is covered with a rubber tip 28 to prevent the support 16 from sliding on the floor during use.

A generally U-shaped bracket 29 is fixed to the edge 22 on each end of the horizontal member 14 by suitable means. Each end of the supportive strap 18 is removably attached to one of the brackets 29 on either end of the horizontal member 14. The supportive strap 18 is flexible and preferably made of cloth. In the preferred embodiment, a metal fastener with a closeable hook is provided on each end of the supportive strap 18. The hook is opened, placed around the bracket 29 and then closed to secure to the hook to the bracket 29. In the preferred embodiment, the length of the supportive strap 18 can be adjusted to fit the particular user.

When the table 10 is in use, the supports are pivoted so that they are perpendicular to the horizontal member 14. The supports are extended to the appropriate length such that the rubber tip 28 on each support 16 is positioned on the ground on either side of the user's legs and in front of the horizontal seat portion 12*a* of the bench 12 and the horizontal member 14 extends over the user's legs. The supportive strap 18 is placed behind the user's back and in front of the vertical back support portion 12*b* of the bench 12. The strap 18 prevents the table 10 from falling away from the user. The supports 16 contact the front surface 30 of the horizontal portion 12*a* of the bench 12 to prevent the table 10 from falling toward the user. Placement of the supports 16 against the front surface 30 of the horizontal portion 12*a* of the bench 12 also provides greater stability for the table 10.

As the space allotted to each user in a stadium is typically limited, it is desirable that the table 10 will fit within the space allotted to each user. In the preferred embodiment, the horizontal member 14 is approximately twenty inches wide and five and one-half inches deep. It has been found that a table 10 which is approximately twenty inches wide will fit within the space allotted for each user at most stadiums. It has also been found that a table 10 which is approximately five and one-half inches deep allows for the table 10 to be placed above the user's legs, without blocking the passageway in front of the user.

Figure 2:
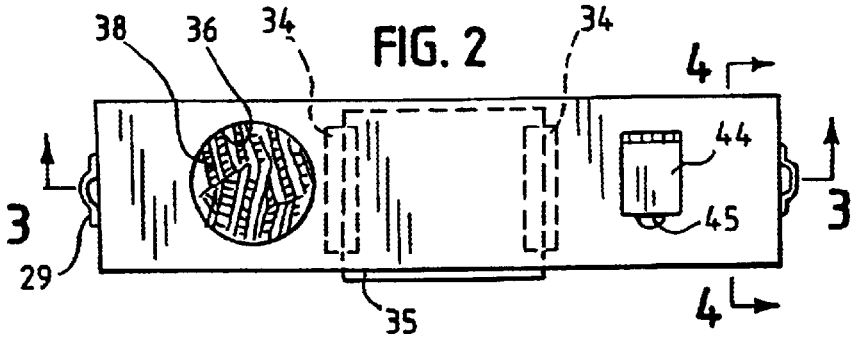
FIG. 2 is a top plan view of the table shown in FIG. 1.
Figure 3:
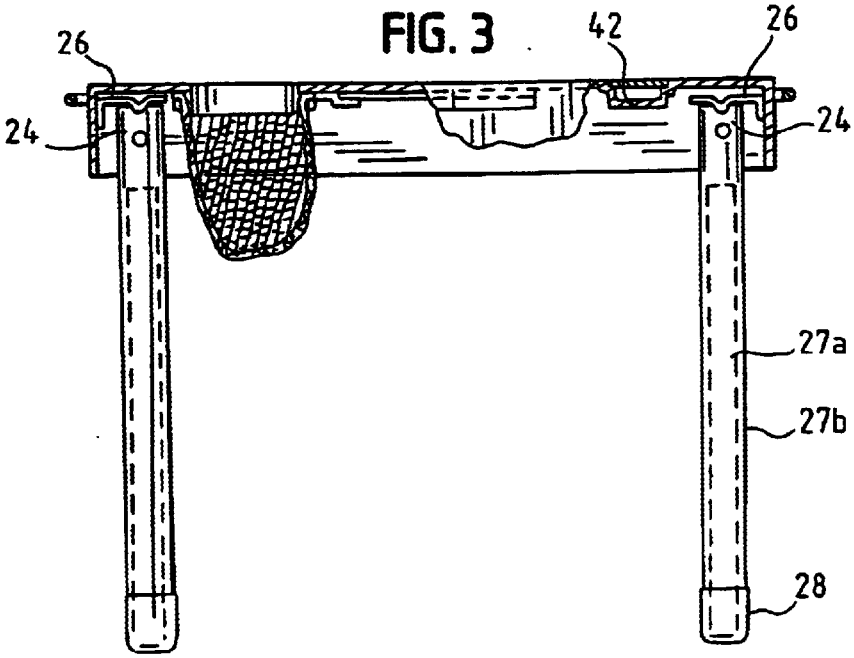
FIG. 3 is a cross-sectional view of the table shown in FIGS. 1 and 2 along line 3—3 of FIG. 2.
Figure 4:
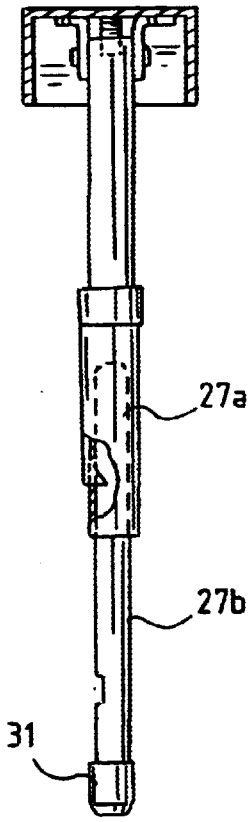
FIG. 4 is a cross-sectional view of the table shown in FIGS. 1–3 along the line 4—4 of FIG. 2.

As shown in FIG. 2, the table provides for a variety of features which assist the user while seated. A tray 32 is slidably attached to the bottom surface of the horizontal member 14 by two tracks 34. The tray 32 provides an extra surface area on which items may be placed, for example, to hold a sandwich. A lip 35 is located at the front edge of the tray 32. To extend the tray 32 the user grasps the lip 35 and pulls the tray 32 outwardly from the horizontal member 14. The lip 35 also prevents the tray 32 from sliding completely under the horizontal member 14 when the tray 32 is returned to its retracted position. The dimensions of the tracks 34 are such that the tray 32 is mounted closely to the bottom surface of the horizontal member 14. Thus, a relatively tight fit is created. Although the user must use force to extend the tray 32, when the tray 32 is pushed back under the horizontal member 14, the tray 32 will remain in place even when the table 10 is being transported. Alternatively, a suitable latch could be used to secure the tray 32 in place.

A first aperture 36 is provided through the horizontal member 14 at a position spaced from the tray 32. A mesh material 38 is attached to the bottom surface of the horizontal member 14 by suitable means around the perimeter of the aperture 36 and depends from the bottom surface of the horizontal member 14 to create a pouch which can be used, for example, to support a beverage.

A second aperture 40 is also provided through the horizontal member 14 and is spaced from the tray 32. A compartment 42 depends from the bottom surface of the horizontal member 14 around the perimeter of the aperture 40. A lid 44 is hingedly attached to the top surface 20 of the horizontal member 22 and covers the aperture 40. This lid 44 allows the compartment 42 to be opened or closed. A small protrusion on the outer edge of the lid 44 mates with a groove in the horizontal member 14 to secure the lid 44 in the closed position. A tab 45 which extends from the lid 44 assists the user in opening the compartment 42. The compartment 42 can be used for storing small items such as, for example, a ticket stub or ear plugs. Preferably, the first aperture 36 is provided on one side of the tray 32 and the second aperture 40 is provided on the opposite side of the tray 32.

A bag 46 is removably attached to the edge 22 of the horizontal member 14. In the preferred embodiment the bag 46 is attached to the edge 22 at a position opposite that of the seated user when the table 10 is in use. Although there are a variety of ways in which the bag 46 could be removably attached to the table 10, in the preferred embodiment, a hook and loop type fastener 48, such as the hook and loop fastener sold under the trademark VELCRO®, is used to attach the bag 46 to the table 10. The mating surfaces of the fastener 48 are a loop surface and a hook surface. A strip of hook type fastener 48*a* is attached to the edge 22 of the horizontal member 14 and a strip of loop type fastener 48*b* is attached to the top edge of the bag 46. The bag 46 can be attached to the table by pressing the loop type fastener 48*b* on the bag 46 to the hook type fastener 48*a* of the table 10. The bag can be used to store items such as, for example, event programs. The bag 46 can be removed from the table 10 by pulling the loop type fastener on the bag 48*b* away from the hook type fastener 48*a* on the table 10. Alternatively, the bag could, for example, be removably attached by using snaps or the like.

Finally, a container 50 is removably attached to said supportive strap 18. The container 50 includes a base portion and a lid and provides additional storage for small items. In the preferred embodiment, a chain is placed through an aperture in the container 50 the ends of the chain are placed around the supportive strap 18 and secured together so that the container is attached to the supportive strap 18.

Figure 6:
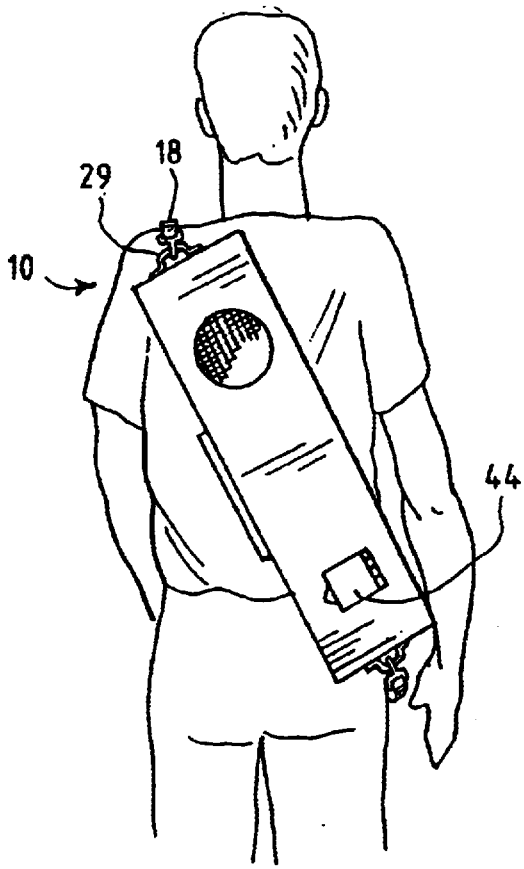
FIG. 6 is a top plan view of the table shown in FIGS. 1–5 being transported by a user.

Transportation of the table 10 can be easily accomplished. Before transporting the table, the user will slide the tray 32 underneath the horizontal member 14, and remove the bag 46 from the edge 22 of the horizontal member 14. The bag 46 can be folded and placed in the compartment 42 for storage. Next, the user collapses the telescoping supports 16 to shorten the supports 16. The user then folds the supports 16 underneath the table 10, as shown in FIG. 5, so that the supports 16 are parallel to the top surface of the horizontal member 14. As described above, the hinges 26 are mounted to the bottom surface of the horizontal member 14 such that when the supports 16 are folded underneath the table 10 the supports 16 are slightly angled relative to the horizontal member 14. The depth of the edge 22 is of sufficient dimension so that when the supports 16 are in the folded position, the supports 16 are flush with the edge 22. Finally, the supportive strap 18 is placed over one of the user's shoulder across the chest and under the opposite arm, as shown in FIG. 6. In the preferred embodiment, the length of the strap 18 is adjustable and thus allows for adjustable positioning of the table 10 upon the user when carried.

While a preferred embodiment of the present invention is shown and described, it is envisioned that those skilled in the art may devise various modifications of the present invention without departing from the spirit and scope of the appended claims.

The invention claimed is:

1. A portable table comprising:

a horizontal member and only two post-shaped support members;

said horizontal member having a top surface, a bottom surface, a first end and a second end;

said first support member, having a fixed end and a free end, wherein said fixed end of said first support member is pivotally attached to said horizontal member proximate said first end;

said second support member, having a fixed end and a free end, wherein said fixed end of said second support member is pivotally attached to said horizontal member proximate said second end;

wherein when the table is in use, said first and said second support members are pivoted to positions generally perpendicular to said horizontal member, an axis of rotation is provided between said free ends of said first and second support members, and the table is rotated about said axis of rotation; and wherein, said first support member pivots in a direction generally toward said second end of said horizontal member to a position generally parallel to said horizontal member and said second support member pivots in a direction generally toward said first end of said horizontal member to a position generally parallel to said horizontal member.

2. A portable table as defined in claim 1, further including a flexible strap having a first end and a second end, wherein said first end of said flexible strap is attached to said first end of said horizontal member and said second end of said flexible strap is attached to said second end of said horizontal member; and wherein when said table is in use, said flexible strap is placed behind a user of said portable table to provide support to said portable table.

3. A portable table as defined in claim 2, further including a compartment removably attached to said flexible strap.

4. A portable table as defined in claim 1, wherein said portable table has a predetermined width and a predetermined depth and wherein the width of said horizontal member is no more than twenty inches and the depth of said horizontal member is no more than five and one half inches.

5. A portable table as defined in claim 1, wherein said first support member and said second support member include means for lengthening or shortening to adjust the position of said horizontal member relative to the ground.

6. A portable table as defined in claim 1, further comprising a tray which is slidably mounted to said horizontal member.

7. A portable table as defined in claim 1, further including an aperture through said horizontal member and a flexible member attached to said horizontal member and surrounding said aperture for supporting a beverage therein.

8. A portable table as defined in claim 1, further including an aperture through said horizontal member, a compartment attached to said bottom surface of said horizontal member, said aperture providing access to said compartment, and a lid hingedly attached to said horizontal member to restrain contents within said compartment.

9. A portable table as defined in claim 1, further including a compartment removably attached to said horizontal member.

10. A portable table comprising:

a horizontal member, only two post-shaped support members, and a flexible strap;

said horizontal member having a top surface, a bottom surface, a first end and a second end;

said first support member, having a fixed end and a free end, said fixed end attached to said horizontal member proximate said first end;

said second support member, having a fixed end and a free end, said fixed end attached to said horizontal member proximate said second end;

said flexible strap having a first end and a second end, said first end of said flexible strap attached proximate said first end of said horizontal member and said second end of said flexible strap attached proximate said second end of said horizontal member;

wherein when said table is in use, said first support member and said second support member are moved to positions generally perpendicular to said horizontal member, said flexible strap partially supports the table in a generally upright position, and an axis of rotation, generally parallel to said horizontal member, is provided between said free ends of said first and second support members, and wherein when said portable table is transported, said first support member and said second support member are moved to positions generally parallel to said horizontal member.

11. A method of using a portable table comprising the steps of:

providing a portable table including a horizontal member, only two post-shaped support members, and a flexible strap;

positioning said first support member, having a fixed end and a free end, perpendicular to said horizontal member;

positioning said second support member, having a fixed end and a free end, perpendicular to said horizontal member;

placing said flexible strap, attached to a first end of said horizontal member and to a second end of said horizontal member, behind the user's back; and pivoting said table toward the user and away from the user about an axis between said free ends of said first and second support members.

12. A method of using a portable table as defined in claim 11, further comprising the step of adjusting the length of said first and second support members so as to adjust the position of said horizontal member relative to the ground.

13. A portable table to be transported by a user comprising:

a horizontal member and only two post shaped support members;

said horizontal member including a first end and a second end;

said first support member, including a fixed end and a free end, wherein said fixed end of said first support member is attached to said horizontal member proximate said first end of said horizontal member;

said second support member, including a fixed end and a free end, wherein said fixed end of said second support member is attached to said horizontal member proximate said second end of said horizontal member;

means for limiting movement of said horizontal member in a direction away from the user;

wherein when said table is transported, said first support member and said second support member are placed proximate said horizontal member; and wherein when said table is in use, said first support member is positioned generally perpendicular to said horizontal member, said second support member is positioned generally perpendicular to said horizontal member, an axis of rotation is provided between said free ends of said first and second support members, and the table is rotated about said axis of rotation.

14. A portable table as defined in claim 13, wherein said means for limiting the movement of said horizontal member in a direction toward and away from the user includes a strap having a first end and a second end and wherein said first end of said strap is attached proximate said first end of said horizontal member and said second end of said strap is attached proximate said second end of said horizontal member.

* * * * *